US010118785B2

(12) United States Patent
Reiman et al.

(10) Patent No.: US 10,118,785 B2
(45) Date of Patent: Nov. 6, 2018

(54) ASSEMBLY AND PROCESS FOR A PRESS FEED MECHANISM FOR PROVIDING RAPID, EFFICIENT AND TUNED HOLD AND RELEASE DISPLACEMENT OF AN UPPER FEED ROLLER RELATIVE TO A LOWER ROLLER AND BETWEEN WHICH IS COMMUNICATED A SHEET MATERIAL FOR SUBSEQUENT FEEDING INTO A PRESS OPERATION

(71) Applicant: CHS AUTOMATION, Roseville, MI (US)

(72) Inventors: Dave Reiman, Livonia, MI (US); Eric Werner, Rochester Hills, MI (US)

(73) Assignee: CHS AUTOMATION, Roseville, MI (US)

( * ) Notice: Subject to any disclaimer, the term of this patent is extended or adjusted under 35 U.S.C. 154(b) by 0 days.

(21) Appl. No.: 15/050,991

(22) Filed: Feb. 23, 2016

(65) Prior Publication Data

US 2016/0251189 A1 Sep. 1, 2016

Related U.S. Application Data

(60) Provisional application No. 62/119,289, filed on Feb. 23, 2015.

(51) Int. Cl.
*B65H 20/02* (2006.01)

(52) U.S. Cl.
CPC ..... *B65H 20/02* (2013.01); *B65H 2403/512* (2013.01); *B65H 2403/514* (2013.01); *B65H 2404/1441* (2013.01); *B65H 2701/173* (2013.01)

(58) Field of Classification Search
CPC ..... B65H 20/02; B65H 2404/1441; B65H 2403/512; B65H 2403/514; B21D 43/09
See application file for complete search history.

(56) References Cited

U.S. PATENT DOCUMENTS

| | | | |
|---|---|---|---|
| 3,362,601 | A | 1/1968 | Ford et al. |
| 3,977,589 | A | 8/1976 | Gentile |
| 4,032,056 | A | 6/1977 | Ito |
| 4,138,913 | A | 2/1979 | Gentile |
| 4,144,990 | A | 3/1979 | Johnson |
| 4,316,569 | A | 2/1982 | Gentile |
| 4,434,924 | A | 3/1984 | Varisco |
| 4,449,558 | A | 5/1984 | Gentile |
| 4,475,863 | A | 10/1984 | Blatt et al. |
| 4,487,352 | A | 12/1984 | Paris |

(Continued)

*Primary Examiner* — Michael C McCullough
(74) *Attorney, Agent, or Firm* — Dinsmore & Shohl LLP

(57) ABSTRACT

A feed assembly for transferring an uncoiled sheet material to a downstream material forming operation. The assembly includes upper and lower feed rolls between which the sheet material passes, the upper roll being actuated between engaging or disengaging positions relative to an upper surface of the sheet material. At least one continuous force applying component is provided for exerting a hold down force against the upper feed roll and, in combination, a programmable counterbalance component is calibrated to counter the hold down force exerted by the force applying component and in order to cycle the upper roller between the engaged and disengaged positions during advance cycling of the uncoiled material to the downstream forming operation.

15 Claims, 15 Drawing Sheets

(56) References Cited

U.S. PATENT DOCUMENTS

| | | | | |
|---|---|---|---|---|
| 4,842,180 | A | 6/1989 | Kato | |
| 5,150,022 | A | 9/1992 | Waddington | |
| 5,197,645 | A | 3/1993 | Nordlof | |
| 5,305,938 | A | 4/1994 | Norollof | |
| 5,657,657 | A | 8/1997 | Welsh et al. | |
| 5,720,421 | A * | 2/1998 | Gentile | B21D 43/09 226/124 |
| 5,755,370 | A | 5/1998 | Gentile et al. | |
| 5,772,095 | A | 6/1998 | Nordlof | |
| 5,808,465 | A | 9/1998 | Gentile et al. | |
| 5,868,296 | A | 2/1999 | Gentile et al. | |
| 7,111,766 | B2 | 9/2006 | Eigenmann | |
| 7,222,764 | B2 | 5/2007 | Eigenmann | |
| 7,374,073 | B2 | 5/2008 | Eigenmann | |
| 8,250,894 | B2 | 8/2012 | Yoshioka | |
| 8,308,036 | B2 | 11/2012 | Kato | |

* cited by examiner

ASSEMBLY AND PROCESS FOR A PRESS FEED MECHANISM FOR PROVIDING RAPID, EFFICIENT AND TUNED HOLD AND RELEASE DISPLACEMENT OF AN UPPER FEED ROLLER RELATIVE TO A LOWER ROLLER AND BETWEEN WHICH IS COMMUNICATED A SHEET MATERIAL FOR SUBSEQUENT FEEDING INTO A PRESS OPERATION

CROSS-REFERENCE TO RELATED APPLICATIONS

This Application claims the benefit of U.S. Provisional Application 62/119,289 filed on Feb. 23, 2015, the contents of which are incorporated herein in its entirety.

FIELD OF THE INVENTION

The present invention relates generally to material roil uncoiling operation, such as in particular assemblies for uncoiling and straightening such as steel roll material prior to feeding into a press or other downstream stamping operation. More specifically, the present invention is concerned with a servo operated feed component of the assembly which operates in conjunction with the downstream located press in order to successively and repetitively grip, advance and release the uncoiled steel roll in a fashion which allows for the stamping or other material press operation to proceed without damage or marring of the uncoiled feed material. A further objective of the present assembly, process and software based medium is to provide for highly tuned and rapid grip and release of the uncoiled material roll, such as which occurs according to finely calculated dimensions factoring in the material thickness of the uncoiled sheet material, this facilitating more rapid and controlled transfer of the uncoiled sheet to the downstream press/stamping operation as well as improving accuracy of the more rapidly fed steel sheet into the successive press operation.

BACKGROUND OF THE INVENTION

The prior art is well documented with numerous examples of press feed mechanisms, such typically including a transfer station positioned in communication with a metal stamping or like machine. The transfer station serves the purpose of aligning and feeding a metal sheet (typically unrolled from a feed drum) into the stamping or other material pressing operation.

To this end, the extending edges of the metal sheet typically include cutout apertures or the like through which engage traversable gripping fingers for moving the sheet along the feed mechanism and into the press operation. The press feed mechanism further includes an arrangement of driving/driven rollers, typically including a displaceable upper roller (often via some type of cam arrangement) moved into and out of contact with a lower roller, between which is communicated the steel sheet.

Disadvantages associated with known press feed mechanisms include the limited degree of inter-adjustability which can be established between the rollers, e.g. such resulting in the upper adjustable roller displacing into either of fully engaged or fully released contact relative to the lower roller and interposed sheet. The result of this is to slow the rate of sheet feed (or advance) between iterative stamping operations, thereby negatively impacting productivity.

Existing press feed assemblies utilize some form of cam feed associated with a drive roller and include each of the oscillating cam feed apparatus of Gentile, U.S. Pat. No. 4,316,569, the high speed cam roll lifter for a press feeder of Johnson, U.S. Pat. No. 4,144,990 and the adjustable input shaft for a press feed of Gentile, U.S. Pat. No. 4,449,658. Additional references of note include Waddington, U.S. Pat. No. 5,150,022 (servo controlled pilot release for a press feeder) and Gentile, U.S. Pat. No. 5,755,370 (press feed with infinitely variable stock material engagement spacing).

Such feed assemblies as described accordingly constitute a final component of a roll uncoiling operation and which handle the transfer the uncoiled and straightened material roll from the initial straightening operation to the downstream located press or stamping operation. As also above described, the feed assembly further typically includes at least one drive roller in close proximity to one or more additional rollers for gripping and advancing the uncoiled material in a manner consisting with the input requirements of the downstream press operation.

Traditional pilot release of feed rollers, also described in the relevant commercial art as "roller venting" can be actuated by one or more air cylinders of various bore size, such as in order to release an upper located feed roll from a corresponding lower feed roll, such further occurring upon lifting the full travel of the cylinder to allow for maximum material thickness clearance according to the machine capacity. In certain instances, the requirement of the air cylinder imparting a full (excessive) travel or lift to the feed roller can be eliminated by the use of adjustable stroke cylinders, such as which can be accomplished in a manual type operation.

For these reasons, accurate controlling of the pilot function for lift rate/speed/travel is difficult to control and is typically results in the utilization of a pre-set motion/rate in the assembly, such further resulting in considerable inefficiencies of operation. It is also found that the return motion of the feed roll cannot be controlled via a given rate or speed and results in imparting undesirable effects onto the uncoiled feed material and as the feed roll contacts the material with uncontrolled force (such as further which take into account the full weight of the feed roll and the upper piloting assembly, or via a slide block assembly).

The net effect of these operational limitations is that they can cause undesirable marking of the uncoiled and fed material, this most notably found in sensitive surface finish materials. As such, combined factors including rate of return, pressure in the cylinder and resultant lift-off or travel cannot be controlled using current technologies and methods, this further evidenced by the position of the feed roll during the lift cycle with the air cylinder not being accurate and further limited by hard stops inside the cylinder or an adjustable threaded rod acting as a hard stop.

SUMMARY OF THE INVENTION

The present invention discloses a feed assembly for transferring an uncoiled sheet material to a downstream material forming operation. The assembly includes upper and lower feed rolls between which the sheet material passes, the upper roll being actuated between engaging or disengaging positions relative to an upper surface of the sheet material. At least one continuous force applying component is provided for exerting a hold down force against the upper feed roll and, in combination, a programmable counterbalance component is calibrated to counter the hold down force exerted by the force applying component and in order to cycle the upper roller between the engaged and disengaged positions during advance cycling of the uncoiled material to the downstream forming operation.

Additional features include a cam shaft with end support cam lobe provided in supported and extending fashion between a pair of side supporting plates. A servo cam and gearbox operates the cam lift components for providing highly tuned and responsive movement of the upper feed roller relative to the lower feed roller.

The servo cam lift operates in conjunction with a pair of the continuous force hold-down components and with the programmable counterbalancing sub-assembly supported between a mounting rail and counter balance mounting beam in order to counter a PSI applied force of the hold down components (also termed air bladders). In this manner, the assembly accomplishes incremental grip and release motion of the upper feed roller in a highly timed and repetitive fashion for effectuating rapid and effective transfer of the uncoiled material to the downstream press operation.

In one non-limiting application, the servo cam can cycle at a range of 0.020 seconds or faster and at a cycling rate of 80-300 iterations per minute or more, at a range further of between 0.000" home position and 0.400" lift position. Other and additional features include pivot linkages respectively associated with first and second brackets, between which the programmable counterbalance component is supported and which, upon being actuated, exerts a lifting force to the mounting rail which is in turn likewise connected to the force applying or air bladder components.

BRIEF DESCRIPTION OF THE DRAWINGS

Reference will now be made to the attached drawings, when read in combination with the following detailed description, wherein like reference numerals refer to like parts throughout the several views, and in which.

DETAILED DESCRIPTION OF THE PREFERRED EMBODIMENTS

Figure 1:
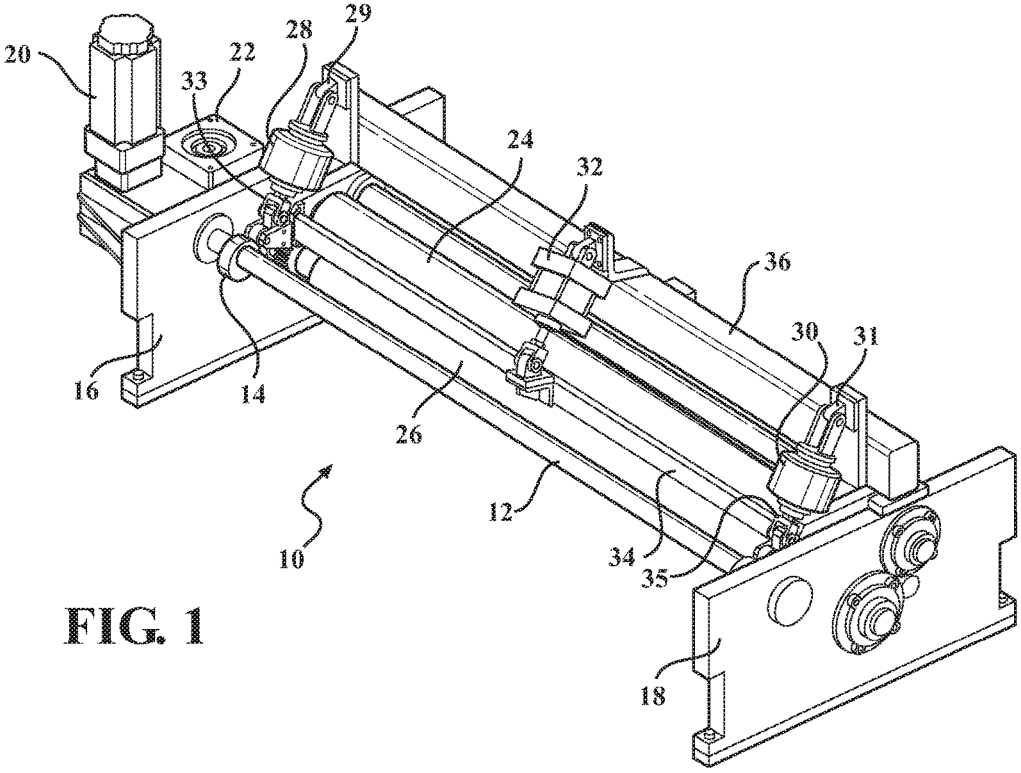
FIG. 1 is a sectional perspective of a feed roller arrangement incorporating a servo-cam piloting lift according to one embodiment of the present invention for providing highly tuned and responsive movement of the upper feed roller, the servo cam lift operation in conjunction with a pair of continuous force hold-down bladders and a programmable counterbalancing sub-assembly for accomplishing incremental grip and release motion of the feed roller in a highly timed and repetitive fashion for effectuating rapid and effective transfer of the uncoiled material to the downstream press operation.

As will be further described with subsequent reference to FIGS. 1-24, the present invention improves upon the prior art by providing an improved servo cam lift type assembly for operating the pilot release of typically an upper feed roll. Referring initially to FIG. 1, a sectional perspective is shown of a feed roller arrangement incorporating a servo-cam piloting lift according to one embodiment of the present invention. For purposes of ease of illustration and explanation, reference is made primarily to the operative servo cam lift and roller components, such remaining components and subassemblies associated with the uncoiling and feeding operation including each of the uncoiler, straightener rolls, loop control and other interrelated components of the servo feed piloting mechanism, being known in the art such that repetitive illustration and description is unnecessary.

Relevant components of the press feed mechanism described herein include a drive or cam shaft 12 with end support cam lobe 14 (see also enlarged views of FIGS. 3 and 6) provided in supported and extending fashion between a pair of side supporting plates 16 and 18 forming a portion of an associated frame. A pair of combination motor and servo/gearbox arrangements are generally depicted by upper motor housings 20 and 22, in combination with driving gears 21, 23 and 25 (see also FIGS. 3 and 8), these intended to generally represent the necessary mechanism of bevel and reduction gearing required for operating the cam lift components (rotating the shaft 12 and lobe 14) for providing highly tuned and responsive movement of a displaceable upper feed roller 24 relative a lower (typically fixed and driven rotating) feed roller 26 with associated driven gear 23 (and between which the uncoiled steel or other sheet material passes).

Figure 2:
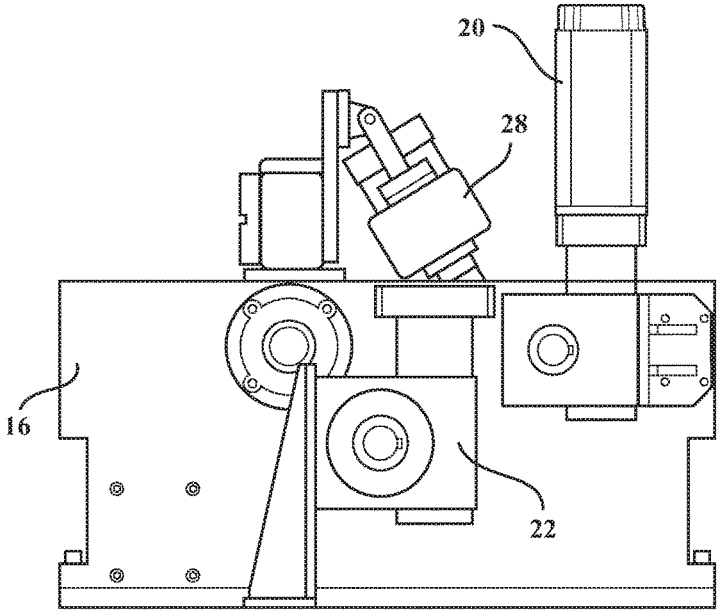
FIG. 2 is a rotated end plan view of the assembly in FIG. 1 and illustrating the servo and pilot components of the assembly.

To that end, the description of the gearing and structure associated with the servo motors and associated gearing to rotating shaft 12 connections is only generally shown and understood to operate with the use of conventionally known gears and related structure as generally illustrated in FIGS. 1-9. FIG. 2 is a rotated end plan view of the assembly in FIG. 1 and again illustrating the servo and pilot components of the assembly. Also illustrated are associated linkages and supports for the servo, gearbox and air bladder (force hold down) components.

As will be further described in additional detail, the servo cam lift operates in conjunction with a pair of continuous force hold-down components 28 and 30 (commonly termed air bladders) and a programmable counterbalancing subassembly 32 (which is supported between mounting rail 34 and counter balance mounting beam 36) counters the PSI applied force of the air bladders 28 and 30 for accomplishing incremental grip and release motion of the upper feed roller 24 relative to the lower fixed position and rotating roller 26 in a highly timed and repetitive fashion for effectuating rapid and effective transfer of the uncoiled material to the downstream press operation.

Figure 3:
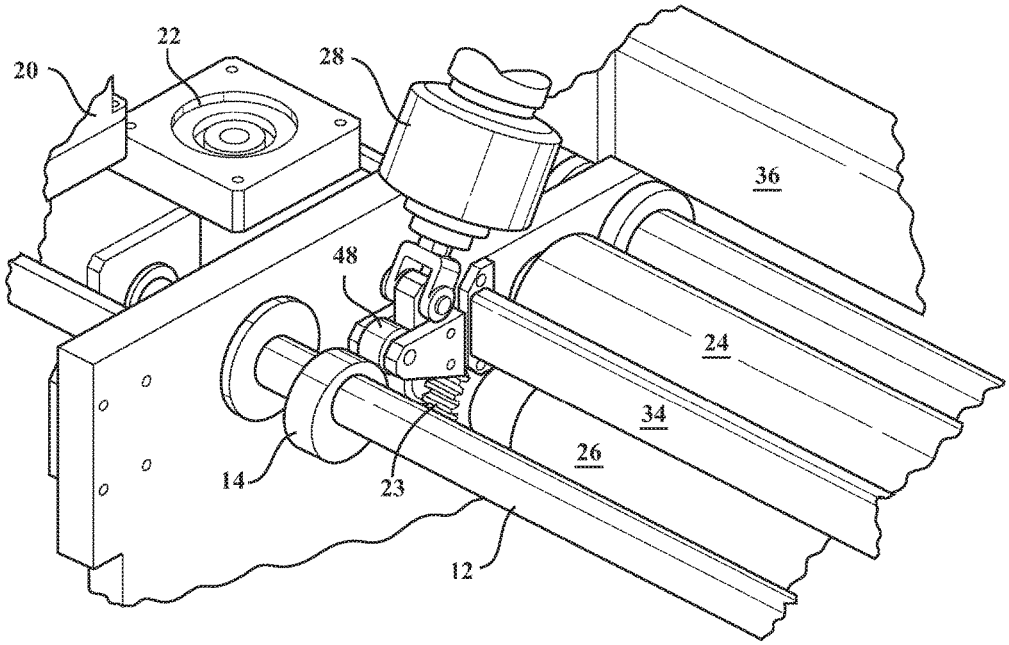
FIG. 3 is an enlarged perspective of FIG. 1 and further illustrating the cam-lift off and counter-force applying air bladder components of the assembly.
Figure 4:
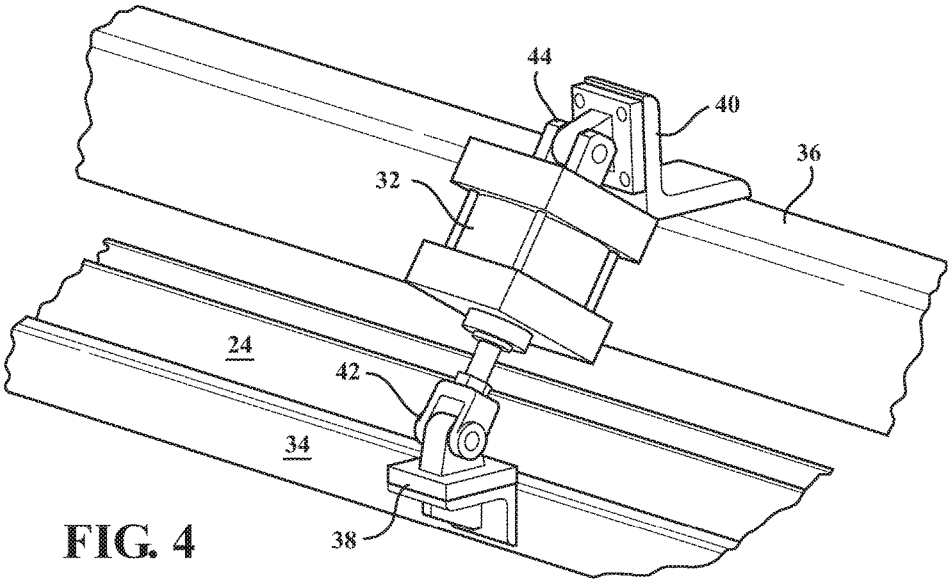
FIG. 4 is a further enlarged perspective depicting the centrally located programmable counterbalance assembly.

FIG. 3 is an enlarged perspective of FIG. 1 and further illustrating the cam-lift off and counter-force applying air bladder components (further again at 28) of the assembly. FIG. 4 is a further enlarged perspective depicting the centrally located programmable counterbalance assembly 32 as above described and further illustrating first 38 and second 40 brackets secured to the mounting rail 34 and counter balance mounting beam 36, respectively. Additional pivot linkages 42 and 44 (such as depicted as but not limited to a clevis type hook and pin) respectively are associated with the first 38 and second 40 brackets, between which the programmable counterbalance assembly 32 is supported and which, upon being actuated, exerts a lifting force to the mounting rail 34 which is in turn likewise connected to the air bladders 28/30 (see again FIG. 3). As best shown again with reference to FIG. 1, the continuous force hold down components 28 and 30 are pivotally connected at upper ends to the crosswise extending counter balance beam 36 via bracket supports respectively shown at 29 and 31.

Figure 5:
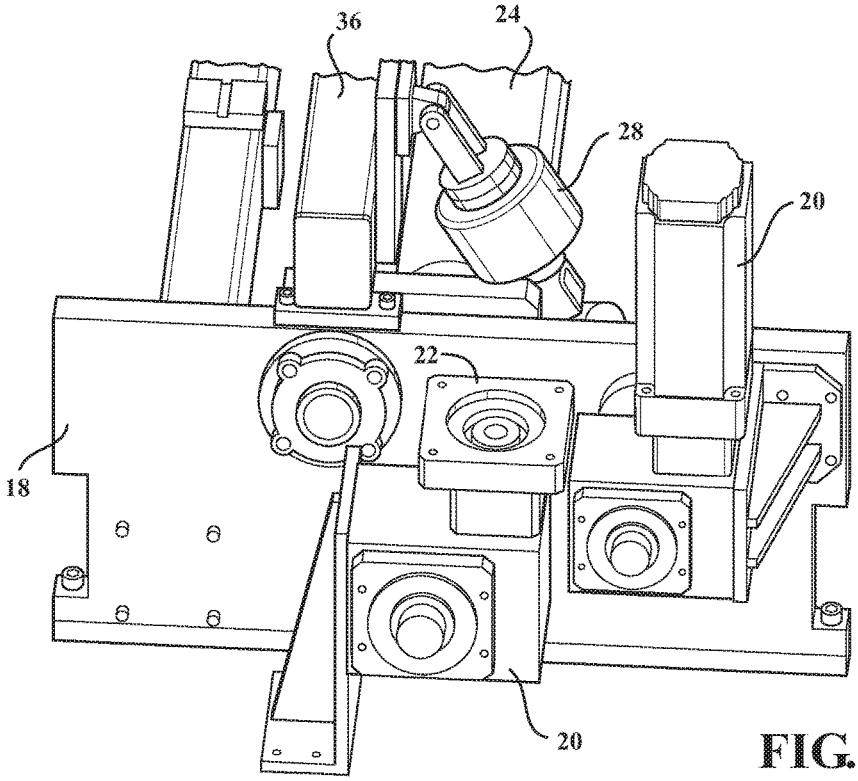
FIG. 5 is an upper perspective of the servo and pilot components of FIG. 2.
Figure 6:
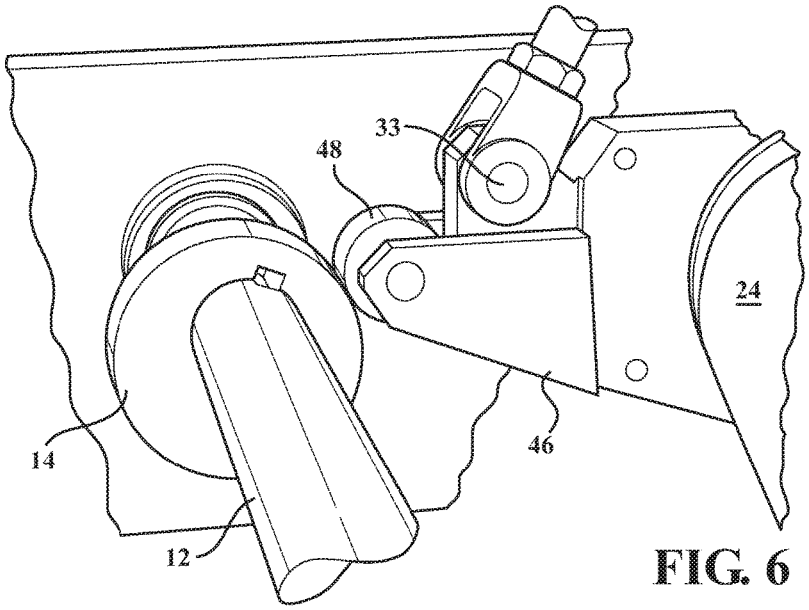
FIG. 6 is an enlarged perspective of FIG. 3 showing the cam and drive roller arrangement for influencing lift travel of the upper feed roller.

FIG. 5 is an upper perspective of the servo and pilot components of FIG. 2 and FIG. 6 is an enlarged perspective of FIG. 3, showing the cam and drive roller arrangement for influencing lift travel of the upper feed roller 24. As partially depicted in FIG. 3, this includes provision of roller plates, see at 46 for selected air bladder 28, with end supported roller 48 in aligning and rotating support upon cam lobe 14 for converting the rotating input of the cam shaft 28 to the lifting of the upper roller 24. As further shown in FIGS. 1 and 3, the lower ends of the hold down components 28 and 30 are pivotally connected at 33 and 35, respectively, to bracket locations associated with the end supported rollers 48 associated with each of the hold down components.

Figure 7:
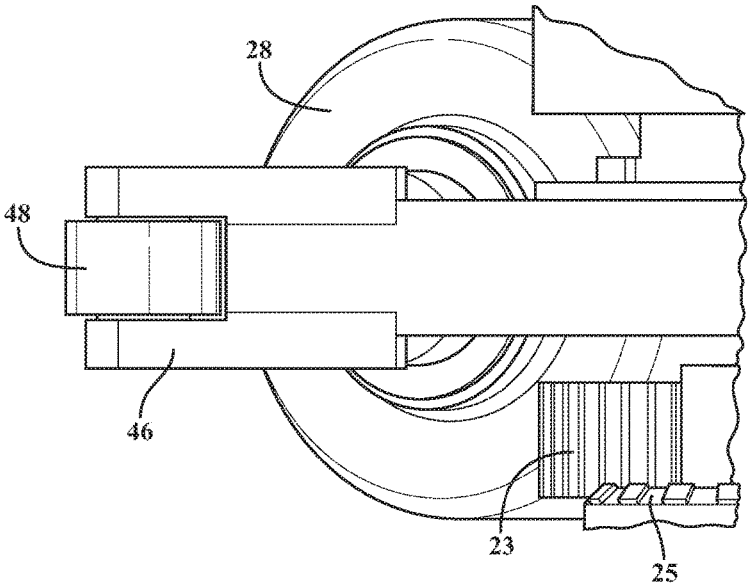
FIG. 7 is a further rotated perspective of the servo cam actuating components of the present invention.
Figure 8:
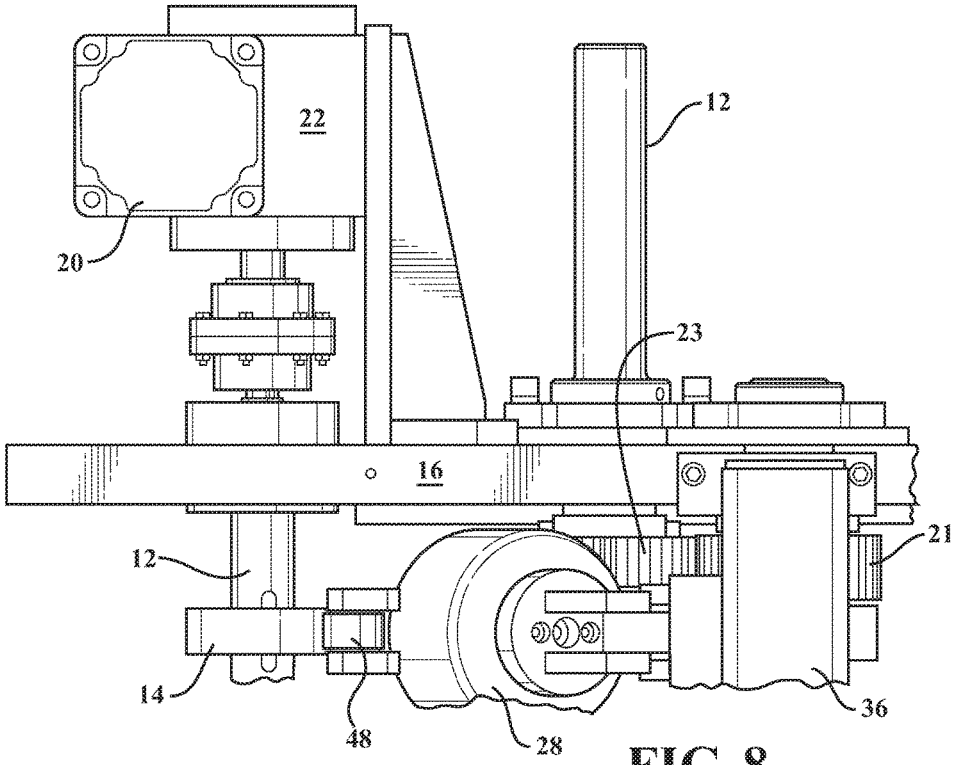
FIG. 8 is a top down looking plan view of the servo cam piloting lift assembly.
Figure 9:
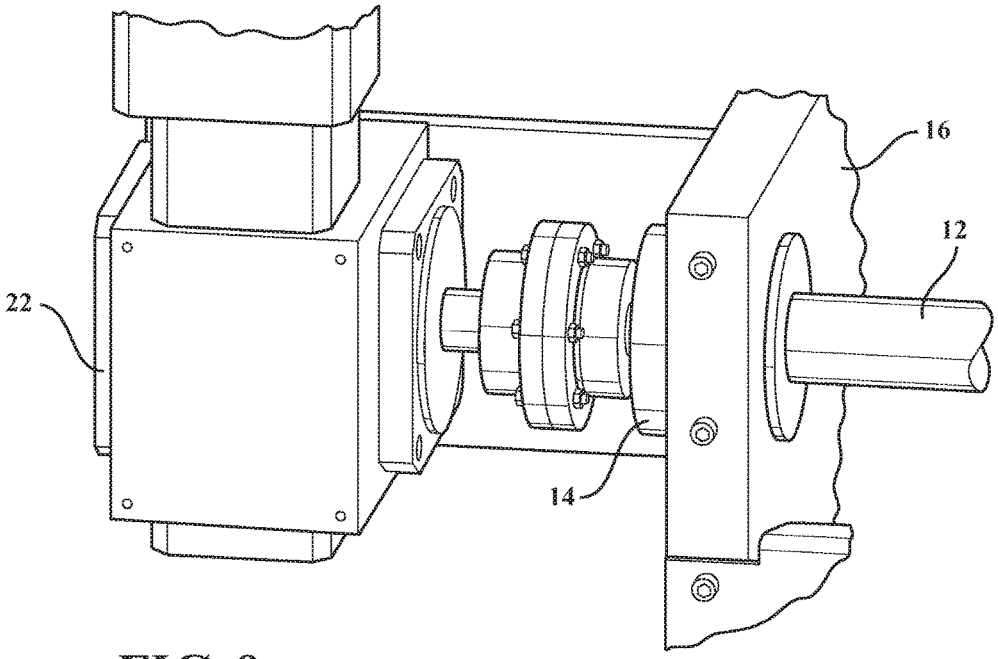
FIG. 9 is an underside looking perspective of the servo cam piloting lift assembly and better illustrating the revised gearbox, coupling and cam shaft components.

FIG. 7 is a further rotated perspective of the servo cam actuating components of the present invention according to one desired design and FIG. 8 is a top down looking plan view of the servo cam piloting lift assembly. FIG. 9 is an underside looking perspective of the servo cam piloting lift assembly and better illustrating the revised gearbox, coupling and cam shaft components. This includes better views of the switch to hollow shafted gearbox (see as previously noted at 22) in communication with the cam 12 and lobe 14.

With the above essential structural description, the servo cam operates in combination with one or more (typically a pair of) continuous hold down force assemblies 28 and 30 (depicted as air bladders however potentially including any other type of mechanical, electro-mechanical, hydraulic or other fluidic force applying construction which may be known in the art) which can be arranged proximate opposite and lateral extending ends of the rollers. Also provided is the further programmable counter balancing component (previously described at 32) which operates with the air bladders and servo cam lift for providing highly responsive and fine-tuned lifting of the upper displaceable feed roller 24 relative to the fixed rotating lower roller 26 (via rotation of the eccentric or cam shaped lobe 14 associated with shaft 12 which translates displacement forces to the end supported roller 48) and in order to facilitate transfer of the uncoiled sheet material from the feed assembly to the material press, stamping operation or the like located downstream from the feeding mechanism.

By this construction, lifting motion of the upper feed roller can be controlled to increments as low as 0.001" with a corresponding rate of lift and return response time of 20 ms (milliseconds) or less. As will also be described, and according to one non-limiting preferred embodiment, the present system is equipped with either any of a single, dual or other multiple of force hold down components (e.g. air bladders) which operate to maintain a constant down pressure on the upper roll (programmable) and which allows for material thickness variations as the uncoiled (steel) material is passing between the upper and lower feed rolls.

The air bladder components further act as cushions in response to sensing variations in the thickness of the uncoiled steel (such commonly being known to account for 5-10% variation in mill steel thickness). Additional features again include the provision of a programmable counterbalance assembly, such exerting a reverse (unseating/lifting) force to the upper feed roll in order to counter the continuous force applying hold down components (air bladders) and which further assists the servo cam lift in overcoming the continuous downward applied forces of the air bladders.

In one non-limiting application, the programmable counterbalancing component can be set to a variable minimum for overcoming the mechanical weight of the assembly (feed roller and associated components) and the existing PSI holding force applied through the air bladders/force hold down components. One known range of settings can include a 0-100 PSI down pressure applied to the upper feed roll (assuming a 2"×4" bore upper air cylinder at 80 PSI=3,400 lbs of down force, and an upper roll assembly weight of approximately 1,000 lbs). A non-limiting variant of the present design allows for up to 8,000 lbs of programmable counterforce.

In operation, the servo cam lift can be set to a minimum desirable lift dimension above the material thickness of the uncoiled steel. By example, and in the instance of the assembly running a 0.100" thick stock, a lift variable can be programmed for 0.0101", with a further minimally desirable proper operational protocol suggesting a lift dimension of 0.008"-0.010".

During setup, an operator can program into the PC readable component a material thickness which in turn operates the positioning of the cam (with resultant lift-off of the upper feed roller). One non-limiting setting would have the cam retract to allow the upper roll to ride on the uncoiled sheet material surface, free from obstruction from the cam. Then, when actuated, the cam would rotate/lift to achieve the desired (programmed) lifting of the upper feed roller above the material thickness of the uncoiled steel, thereby allowing the material to "float" for the pilot function. Upon subsequently receiving a signal to close, the cam would then reverse rotate (retract) back to the current home position to allow the sheet material to be gripped and thereby advanced and allowing the force holding components (air bladders) to apply their rated PSI pressure in full.

Figure 10:
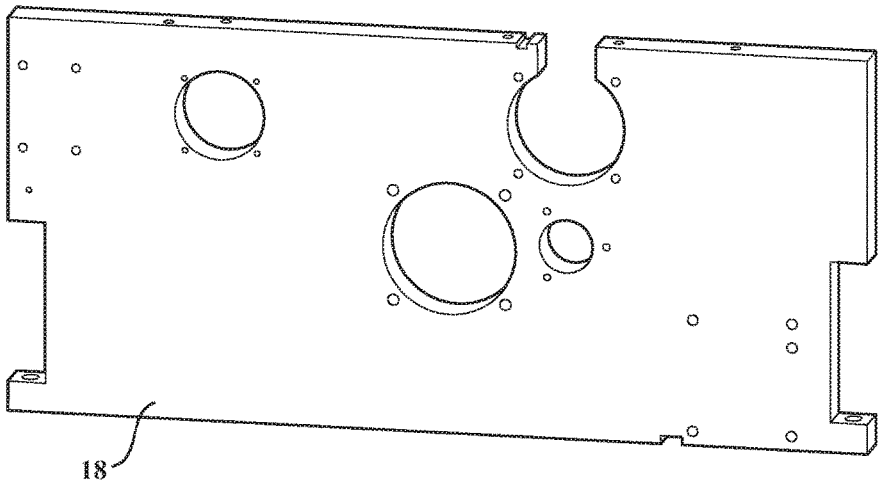
FIG. 10 is a perspective of a side plate component associated with the present assembly.
Figure 11A:
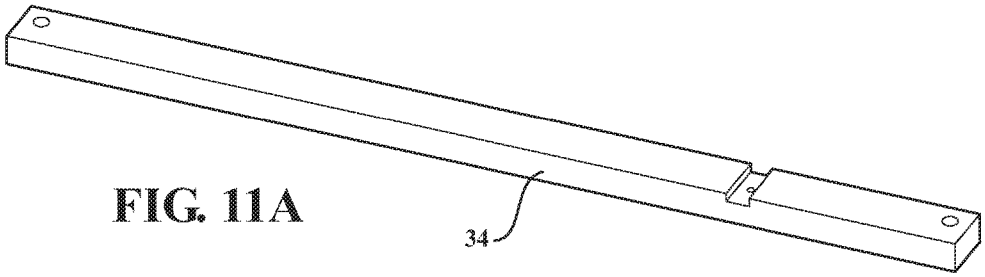
FIGS. 11A-11B present illustrations of the C-mounting rail and cam shaft components.
Figure 11B:
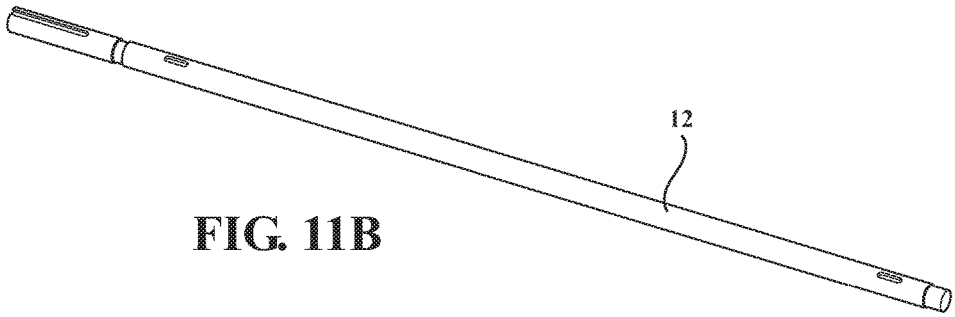
Figure 12:
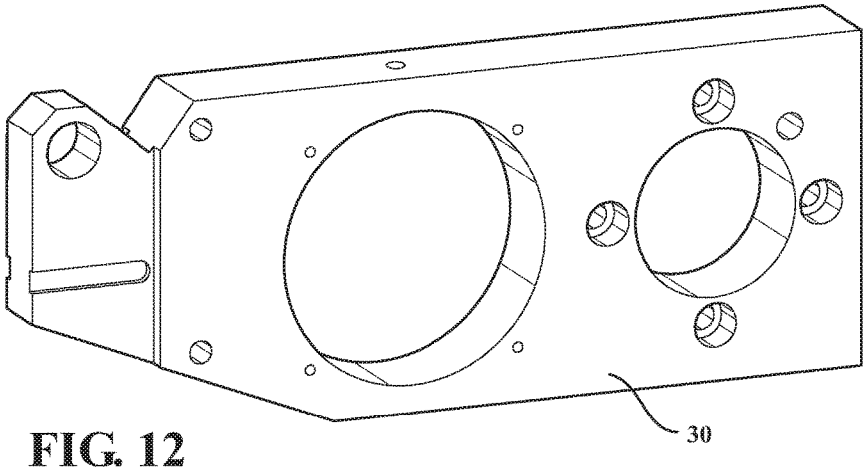
FIG. 12 is an illustration of an upper feed roll pivot side plate associated with the servo piloting lift assembly.

Referring back to the illustrations, FIG. 10 is a perspective of a side plate component 18 associated with the present assembly and including the notching configuration for supporting the various support components for the cam 12, upper roller 24, lower roller 26, etc. FIGS. 11A-11B present illustrations of the C-mounting rail 34 and cam shaft 12 components. FIG. 12 is an illustration of an upper feed roll pivot side plate, at 50, associated with the servo piloting lift assembly.

Figure 13A:
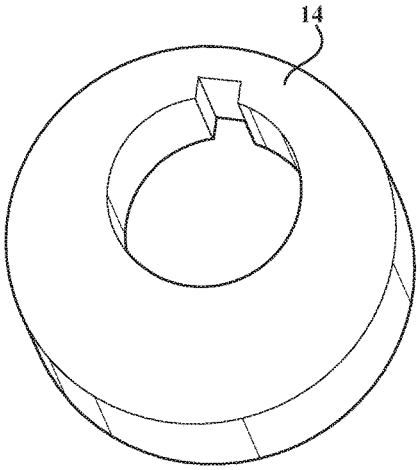
FIGS. 13A-13B are illustrations of the cam lobe and cam thrust cap components associated with the servo cam piloting feed roll assembly.
Figure 13B:
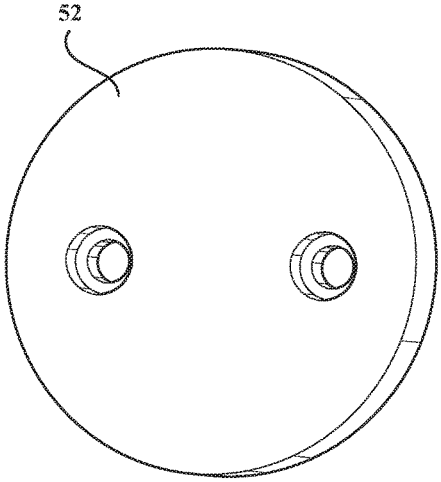
Figure 14A:
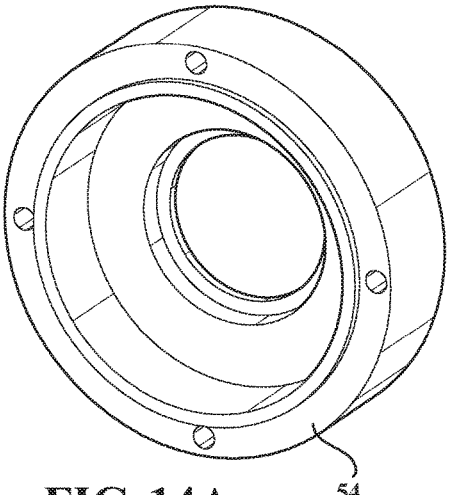
FIGS. 14A-14B provide illustrations of the cam bearing seal plate (driver side) and cam bearing seal plate (operator side)
Figure 14B:
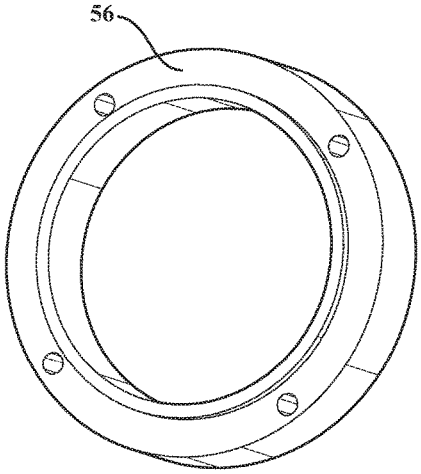

FIGS. 13A-13B are illustrations of the cam lobe (again at 14) and cam thrust cap (further at 52) components associated with the servo cam piloting feed roll assembly. FIG. 14A-14B provide illustrations of the cam bearing seal plate (driver side) 54 and cam bearing seal plate (operator side) 56.

Figure 15A:
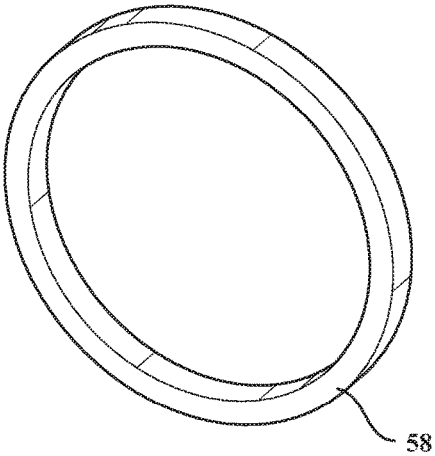
FIGS. 15A-15B provide illustrations of the cam bearing spacer and cam thrust spacer components.
Figure 15B:
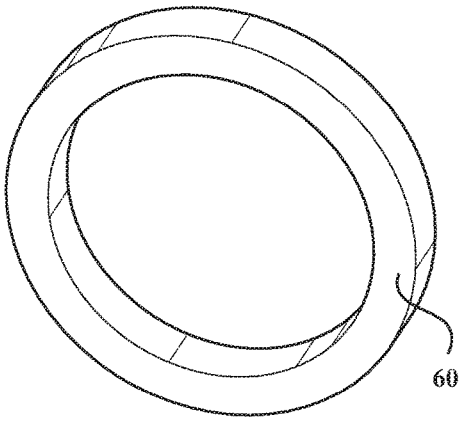
Figure 16:
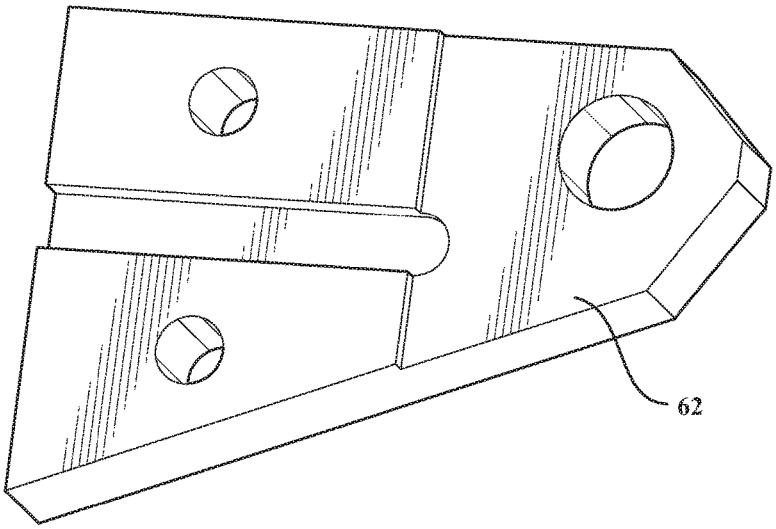
FIG. 16 is an illustration of a cam follow mounting plate component.

FIGS. 15A-15B provide illustrations of the cam bearing spacer 58 and cam thrust spacer 60 components. FIG. 16 is an illustration of a cam follow mounting plate component 62.

Figure 17A:
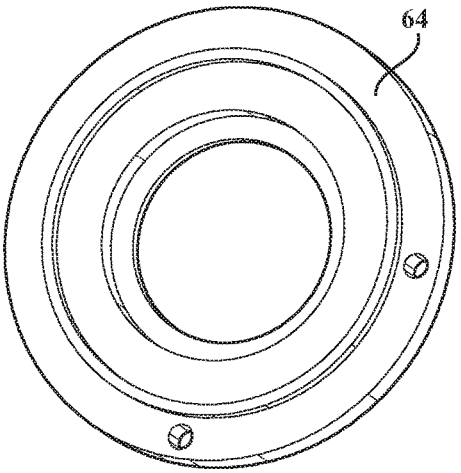
FIGS. 17A-17B are illustrations of the inner cam bearing seal plate and air bladder mounting plate components.
Figure 17B:
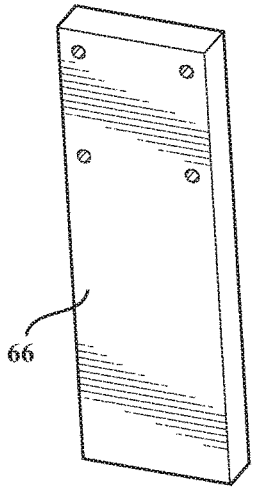
Figure 18:
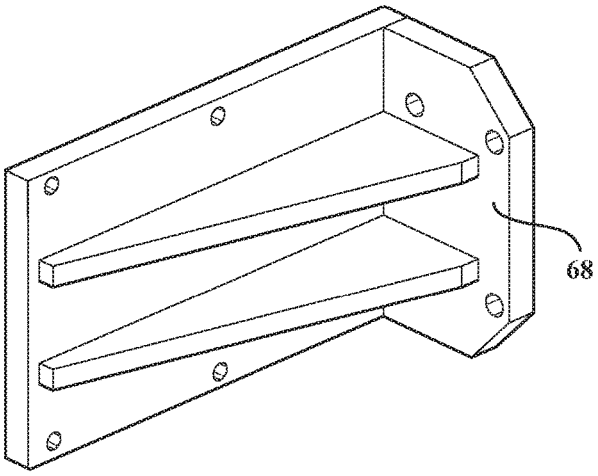
FIG. 18 is an illustration of the anti-rotate bracket component.
Figure 19:
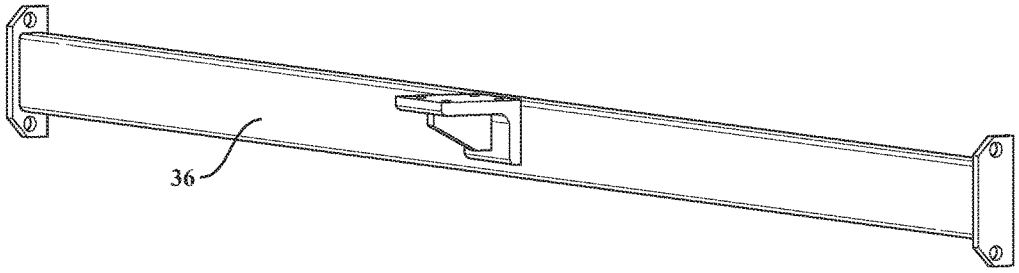
FIG. 19 is an illustration of the counter balance mounting beam.
Figure 20A:
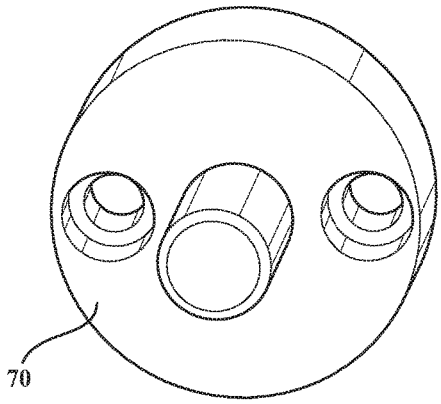
FIGS. 20A-20B are illustrations of the front and rear air bladder supporting bracket components.
Figure 20B:
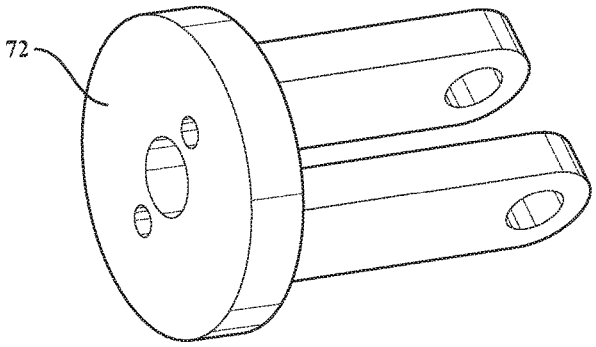

FIGS. 17A-17B are illustrations of the inner cam bearing seal plate 64 and air bladder mounting plate 66 components. FIG. 18 is an illustration of the anti-rotate bracket component 68. FIG. 19 is another illustration of the counter balance mounting beam, again at 36, and FIGS. 20A-20B provide illustrations of front 70 and rear 72 air bladder supporting bracket components.

Figure 21:
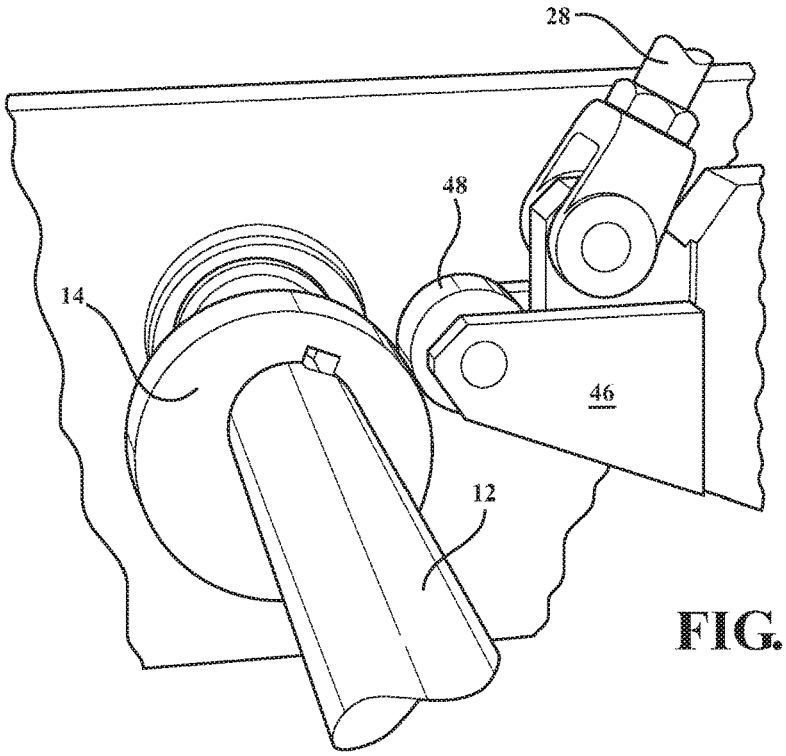
FIG. 21 is an illustration of the pilot feed servo cam in a first home rotated position (0.000" roll gap)
Figure 22:
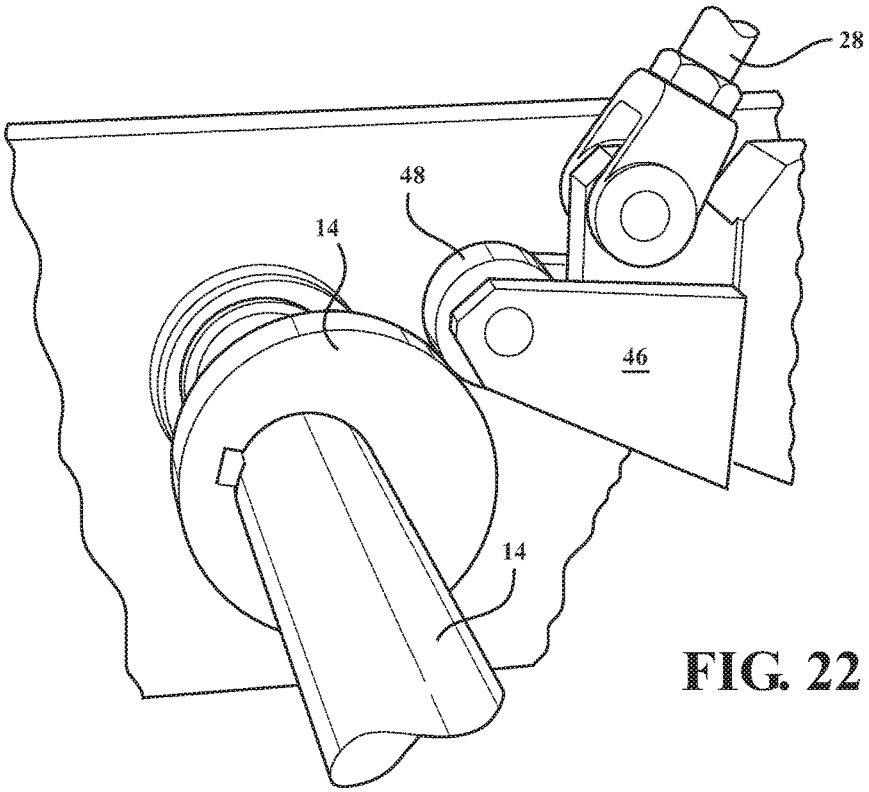
FIG. 22 is a succeeding illustration of the pilot feed servo cam in a second lift rotated position (0.400" roll gap)

FIG. 21 provides an illustration of the pilot feed servo cam in a first home rotated position (0.000" roll gap), see again cam shaft 12 and associated cam lobe 14 in contact with roller plate 46 and roller 48 of end selected air bladder 28. FIG. 22 is a succeeding illustration of the pilot feed servo cam in a second lift rotated position (0.400" roll gap).

Figure 23:
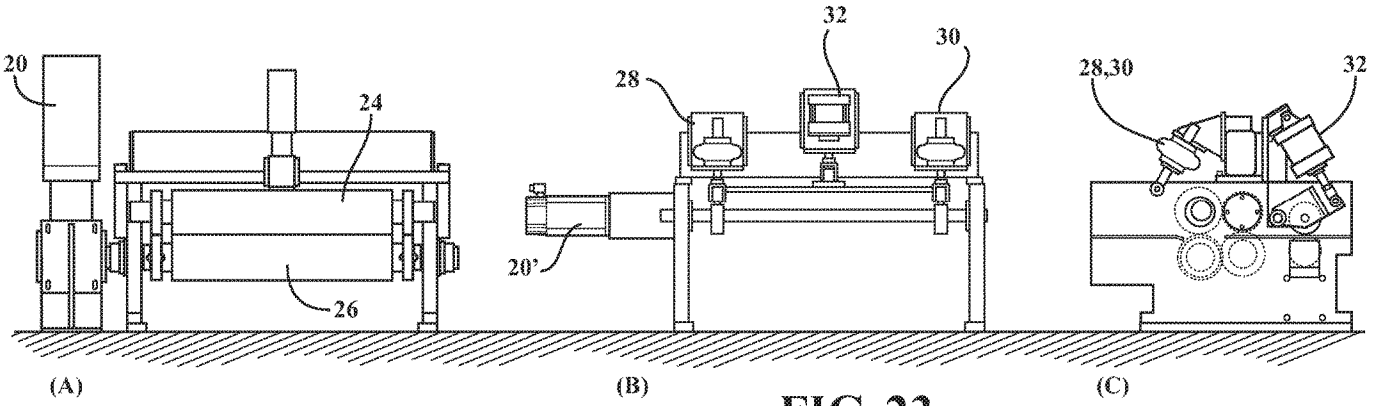
FIG. 23 provides a succession of front, rear and side diagrammatic illustrations, respectively, of the servo roll feed assembly with upper and lower feed rolls and high speed servo operated cam shaft in combination with first and second hold down air bladders and programmable counterbalancing component.
Figure 24:
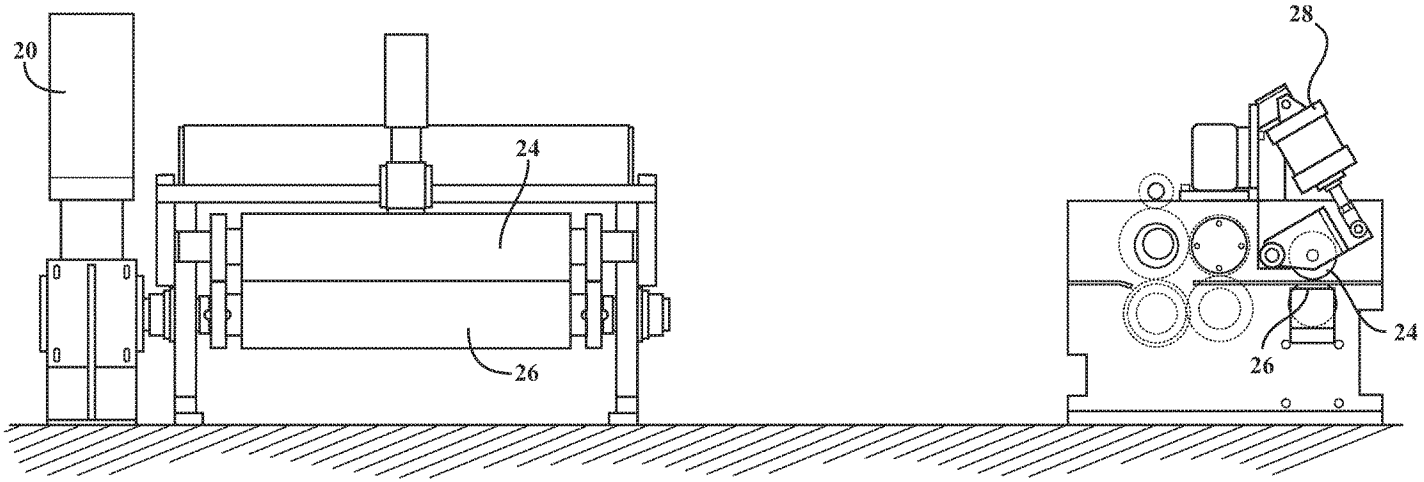
FIG. 24 provides a succession of additional front and side diagrammatic illustrations of the servo operated roll feed assembly of FIG. 23.

FIG. 23A-23C are front, rear and side diagrammatic illustrations of the servo roll feed assembly with upper and lower feed rolls and high speed servo operated cam shaft in combination with first and second hold down air bladders and programmable counterbalancing component. FIGS. 24A and 24B provide second front and side diagrammatic illustrations of the servo operated roll feed assembly of FIG. 23.

Figure 25:
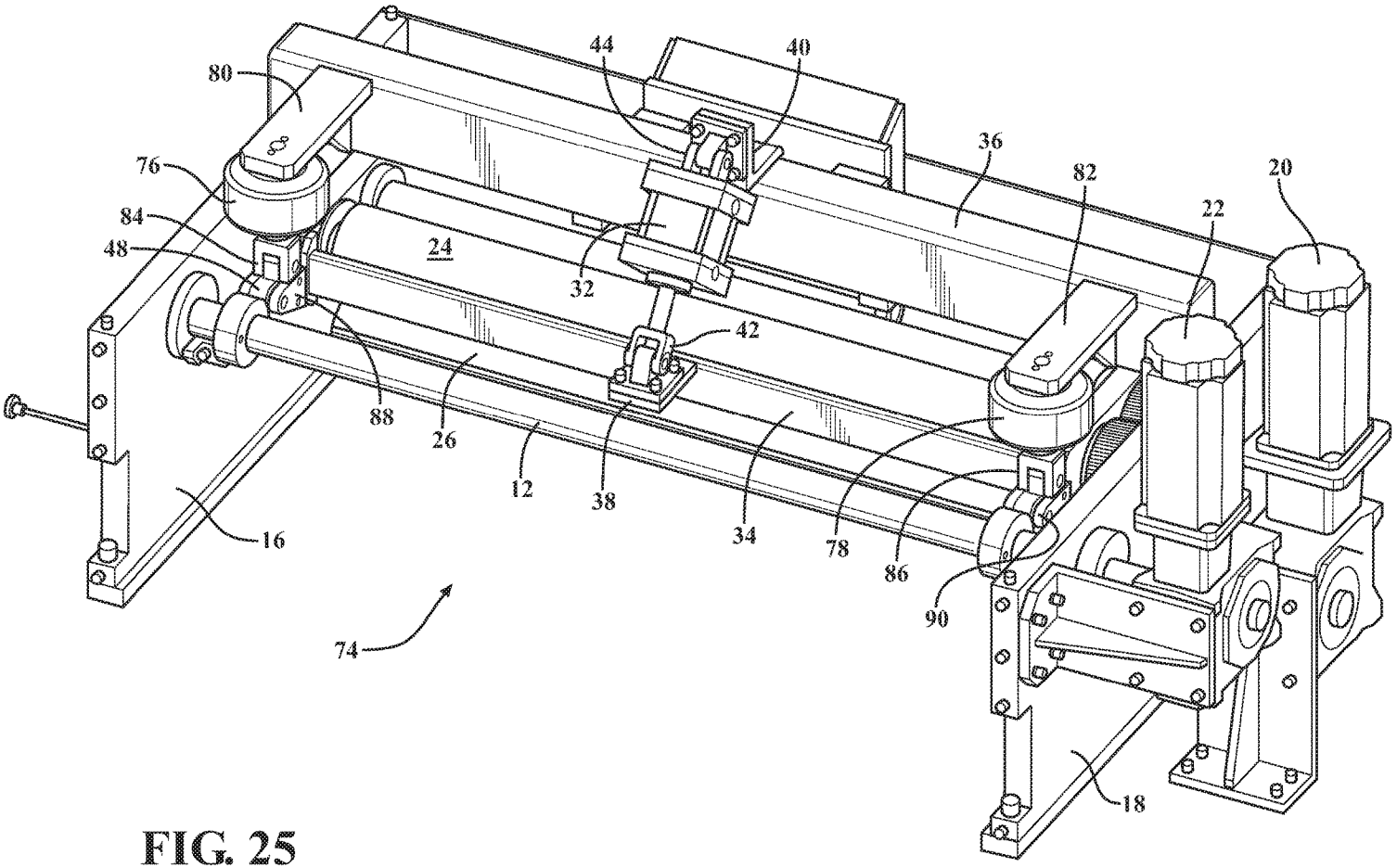
FIG. 25 is a perspective view similar to FIG. 1 of a further variant of a feed roller arrangement and showing a pair of outer and vertically downwardly supported continuous force hold down components.

FIG. 25 is a perspective view, generally at 74, similar to FIG. 1 of a further variant of a feed roller arrangement and in which the pair of outer hold-down components (originally at 28 and 30 in FIG. 1) are reconfigured at 76 and 78 in vertically downwardly supported and spaced apart fashion. As further shown, a pair of brackets 80 and 82 are provided and which anchor in horizontally and forwardly extending fashion from the crosswise extending counter balance beam 36.

The force hold down components 76/78 are further depicted anchored to undersides of the brackets 80/82 in downwardly extending (as opposed to angled fashion as in FIG. 1). As with FIG. 1, a clevis hanger and pin arrangement (see at 84 and 86, respectively) is provided for pivotally mounting the lower ends of the hold down components 76/78 to the supporting frame of the mounting rail 14 for controlling displacement of the upper roller 24, again via the roller 48 interface with the eccentric cam lobe 14 mounted to the end of the shaft 12.

See also as further shown bracket supports 88 and 90 which are also depicted in FIG. 1 and which extend forwardly from the mounting rail 34, to which the lower clevis hanger and pin 84/86 of the hold down components 76 and 78 are anchored in a generally vertical (90°) direction, and as opposed to a substantially angular (45°) fashion as with the hold down components 28 and 30 of FIG. 1. Without limitation, the angle of linear extension of the continuous force hold down components and/or of the counterbalance component can be modified from that shown and is selected according to the desire to achieve an optimal force application in order to finely tune the rapid engagement/release of the upper drive roller 24 relative to the lower roller 26.

Figure 26:
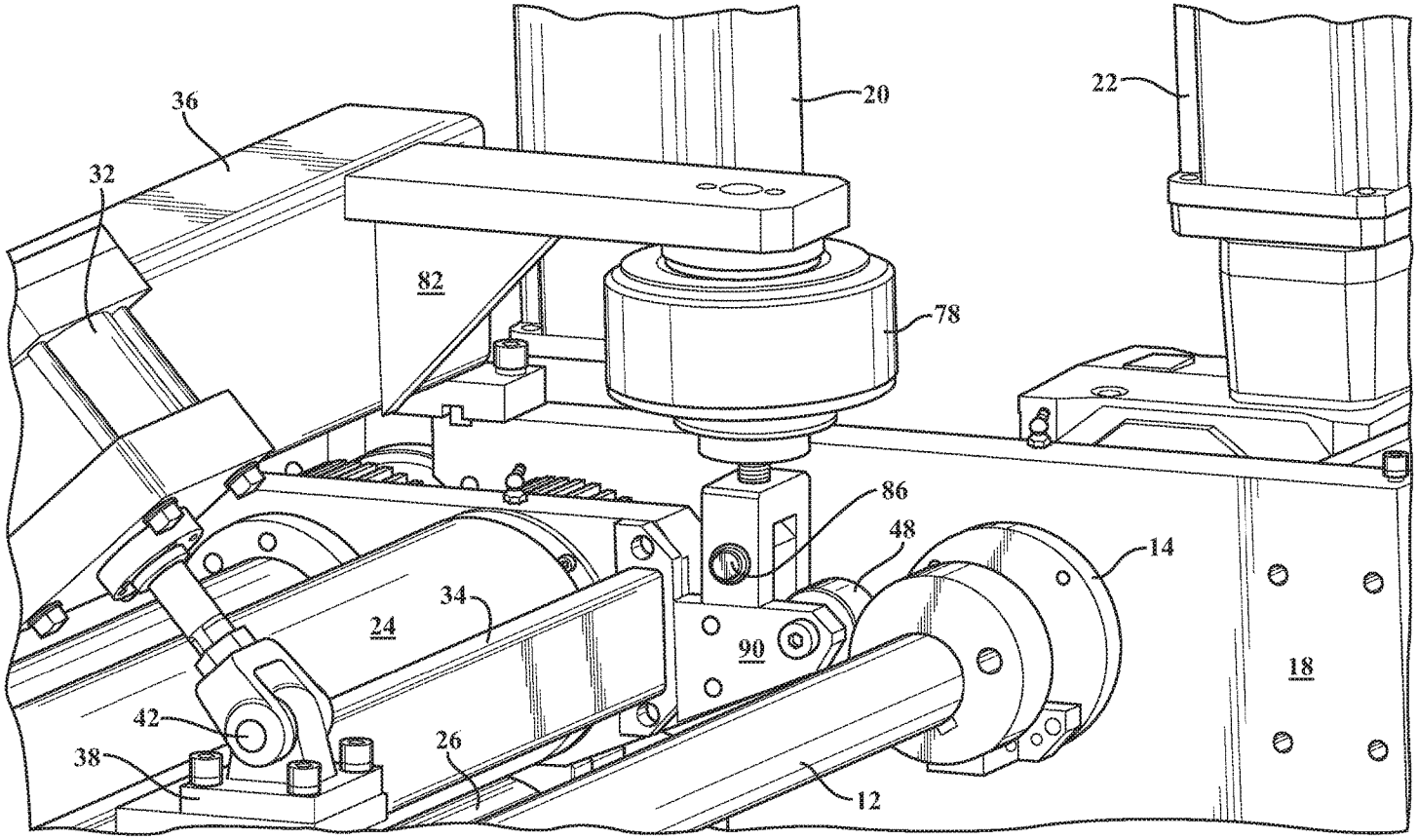
FIG. 26 is an enlarged sectional view of a selected end supported hold down component and better depicting the upper anchoring to the fixed overhead cross beam, in combination with the lower linkage connecting aspect to the mounting rail supporting the displaceable upper roller frame.
Figure 27:
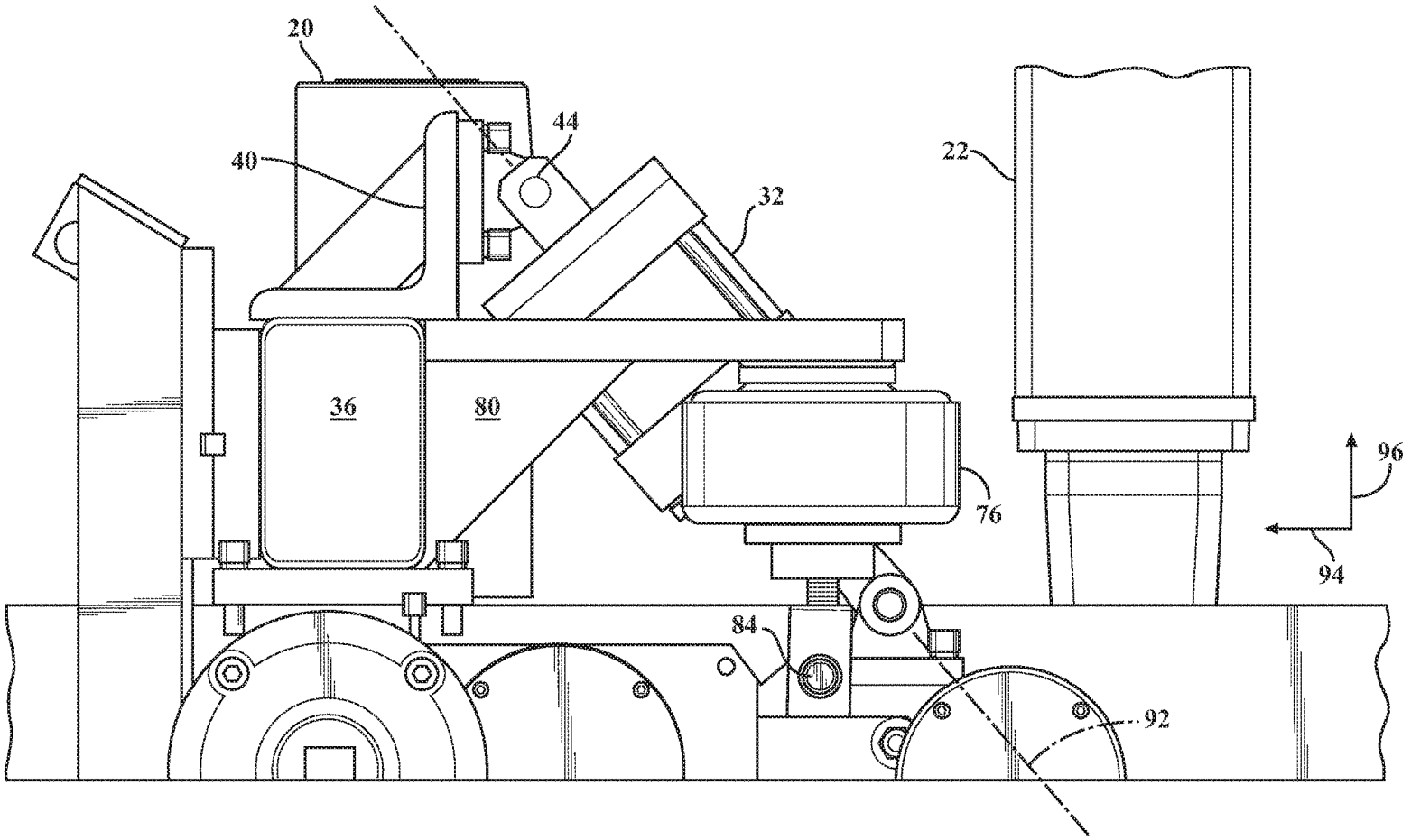
FIG. 27 is an end plan view of the arrangement of FIGS. 25-26 and depicting the arrangement established between the center counter balancing component and the pair of end supported hold down components.

FIG. 26 is an enlarged sectional view of a selected end supported hold down component and better depicting the upper anchoring to the fixed overhead cross beam 36, in combination with the lower linkage connecting aspect to the mounting rail 34 supporting the displaceable upper roller frame. FIG. 27 is an end plan view of the arrangement of FIGS. 25-26 and depicting the arrangement established between the center counter balancing component 32 (identically as shown in FIG. 1) in combination with the reconfigured outer spaced pair of end supported hold down components 76 and 78. As also shown in FIG. 4, the counterbalance component 32 includes a generally linear extending length defined by axis 92 (see again FIG. 27) relative to either of horizontal 94 or vertical 96 axes. The other components of the transfer assembly as generally as previously described in FIGS. 1 et seq.

Additional key components of the servo pilot mechanism include the servo motor being sized in any desired range (such as 70-600 in-lb), with the corresponding gearbox assembly exhibiting a calculated ratio ranging from 1:1 to 25:1. The gearbox utilized can further exhibit zero or low backlash properties and can further include any of an in-line or right angle type construction.

The camshaft assembly utilized can further be mounted within a housing via taper roll bearings with locknuts and washers. Alternately, other economical assemblies are envisioned which can include any type of bushing arrangement.

The programmable (air) counterbalancing component 32 can also envision utilizing any other type of mechanical (including electro-mechanical servo variant), pneumatic or hydraulic redesign (or can provide a combination of all) such as in order to eliminate the upper roll 24 and assembly weight and to assist in overcoming the PSI down force exerted by the hold down (air bladder 28/30) components. To this end, additional redesigns of the invention contemplate single or dual air bladders utilized for providing feed roll pressure, such further with or without mechanical spring counterbalances.

It is also generally accepted that a servo pilot release provides improvements over standard air release options which define the industry standard. It is further understood that the "process" or "operation" of the pilot release cycle function during the stamping process/cycle of the press can have substantial impact on the accuracy of the feed mechanism, such as in which the rapid tuning of the upper roller 24 in effect causing the feeder to "release" the steel to float.

Additional factors include adjustment to the pilot timing in order to effect part length, mostly due to the "Lag" time associated with Air release. In this fashion, the timing of the servo release greatly improves this accuracy by minimizing the lift above the steel and the rate of return in which the feed rolls (24 and 26) close or contact.

By virtue of such an arrangement, factors eliminated in a traditional setup of the feed mechanism include energizing the solenoid valve, the time for air to travel to lift cylinders, the time needed to fill the cylinder with air and in order to achieve the proper pressure, the cylinder lift time and, finally, the cylinder lift travel. In reverse operation, time delays include for each of the spool being closed on the solenoid valve, forcing the air from the cylinder "dump air", the time for the cylinder to travel from full open back to closed position, and finally for the roller 24 to meet or contact the sheet material (concerns here are force of impact and possible material marking).

The high speed servo mechanism incorporated into the present invention largely eliminates the time it takes for the above pre-existing process, and by the rapid movement of the servo cam lift. The present mechanism also helps reduce "long feeds" and "short feeds" associated with the pilot release portion of the press cycle when using an air system, mostly due to timing lag.

A programmable setting allows for a down force applied to the upper feed roll 24, and which again is calibrated in order to absorb variances in material thickness as the uncoiled steel passes through the feed machine to the downstream press or other stamping operation. Other variants include provision of a shaft mount style cam follower. An eccentric shaft can also be incorporated, and which may have less than a 0.006" (torsional) twist with 36,000 inLbs applied.

Yet additional operational considerations include the cycling/response time (such as between the positions of FIGS. 21-22) of the assembly being calibrated within the range of 0.020 seconds or less, with unit cycling of up to 80-300 times per minute. Positive encoder feedback position on the servo motor can translate into a 0.400" maximum lift dimension of the upper roller 24 via the cam shaft and lobe, with the further ability incorporated into the system in order to lift the roller a minimal distance (such as in one non-limiting application being incremental from between 0.001"-0.400") over the material thickness of the uncoiled steel, and further contemplating that a 0.10" lift distance can be a generally acceptable mid-range variable. Other factors include the desirability of micro adjusting the cam lift up or down during material running in auto mode, with the servo cam fully retracting, in one application, approximately 0.020" past zero in order to allow the air bladders 28/30 to apply full down pressure as set for that application.

As also previously described, the air bladder pressure may be programmable within the parameters (job recipe) programmed into the PC component of the assembly, the air counterbalancing pressure (component 32) is also a programmable aspect and can include a minimal pressure setting for countering or eliminating the combined weight of the upper pivot assembly and roller weight (such as approximately 900 lb for a 48 machine with 6" rolls). Other considerations may include incorporating a maintenance program that fully cycles the servo and gearbox to help reduce in wear (factoring that the servo will only be moving back and forth most of the time in small increments). A manual mode may also be utilized to cycle programmed lift during setup.

The associated service screen utilized with the PC component of the servo cam is desirously accessed by authorized personnel only, such as via password input. This functionality can further include each of calibrating to zero, adjusting acceleration/deceleration of the cam lift profile, adjusting velocity, etc. This can further envision different profiles being programmed which, for example, applies to sensitive or pre-painted uncoiled materials in which softer closing or gripping of the upper roller is desired in order to prevent material wear or damage during cycling.

By its construction, the combination of the continuous hold down force applying components 28/30 and the opposing or counter force exerting component 32 operate in order to finely tune or adjust both the force of contact exerted between the rollers 24 and 26, as well as the creation of a minute separate distance therebetween. This combination further permits the inter-communicated sheet of steel material to be precisely advanced and, when initiating the subsequent press operation, to securely and effectively grip the steel sheet in order to prevent bending/creasing to the same or misalignment at the entry location to the adjoining press. In this fashion, the present invention provides for both faster and more accurate feeding of the uncoiled steel sheet in the succeeding press or other stamping/forming operation than has been heretofore possible.

Having described my invention, other and additional preferred embodiments will become apparent to those skilled in the art to which it pertains, and without deviating from the scope of the appended claims.

We claim:

1. A feed assembly for transferring an uncoiled sheet material to a downstream material forming operation, said assembly comprising:

a frame supporting upper and lower feed rollers between which the sheet material passes, at least one of said rollers being rotary driven, said upper roller being actuated between engaging or disengaging positions relative to an upper surface of the sheet material;

a cam shaft with end support cam lobe provided in supported and extending fashion between a pair of side supporting plates;

at least one continuous force applying component exerting a hold down force against said upper feed roller; and a programmable counterbalance component calibrated to counter the hold down force exerted by said force applying components and in order to cycle the upper roller between the engaged and disengaged positions during advance cycling of the uncoiled material to the downstream forming operation.

2. The assembly as described in claim 1, further comprising a servo cam and gearbox for operating said cam shaft for providing responsive movement of said upper feed roller relative to said lower feed roller.

3. The assembly as described in claim 2, said servo cam operates in conjunction with a pair of said continuous force hold-down components and said programmable counterbalance component supported between a mounting rail and counter balance mounting beam in order to counter a PSI applied force of said hold down components for accomplishing incremental grip and release motion of said upper feed roller in a repetitive fashion for effectuating transfer of the uncoiled material to the downstream forming operation.

4. The assembly as described in claim 3, said servo cam cycling at a range of 0.020 seconds and at a cycling rate of 80-100 per minute.

5. The assembly as described in claim 4, said servo cam cycling range further comprising being between a 0.000" home position and a 0.400" lift position.

6. The assembly as described in claim 3, further comprising pivot linkages respectively associated with first and second brackets, between which said programmable counterbalance component is supported and which, upon being actuated, exerts a lifting force to said mounting rail which is in turn likewise connected to said pair of continuous force hold down components.

7. A feed assembly for transferring an uncoiled sheet material to a downstream material forming operation, said assembly comprising:

a frame supporting a displaceable upper feed roller and a fixed lower feed roller between which the sheet material passes, at least one of said rollers being rotary driven, said upper roll being actuated between engaging or disengaging positions relative to an upper surface of the sheet material;

a cam shaft with end support cam lobe provided in supported and extending fashion between a pair of side supporting plates;

a spaced apart pair of continuous force applying components exerting a hold down force against said upper feed roll; and a programmable counterbalance component located between said pair of force applying components, said counterbalance component being calibrated to counter the hold down force exerted by said force applying components and in order to cycle the upper roller between the engaged and disengaged positions during advance cycling of the uncoiled material to the downstream forming operation.

8. The assembly as described in claim 7, further comprising a servo cam and gearbox for operating said cam shaft for providing responsive movement of said upper feed roller relative to said lower feed roller.

9. The assembly as described in claim 8, said servo cam operates in conjunction with said pair of continuous force hold-down components and said programmable counterbalance component supported between a mounting rail and counter balance mounting beam in order to counter a PSI applied force of said hold down components for accomplishing incremental grip and release motion of said upper feed roller in a repetitive fashion for effectuating transfer of the uncoiled material to the downstream forming operation.

10. The assembly as described in claim 9, said servo cam cycling at a range of 0.020 seconds and at a cycling rate of 80-100 per minute.

11. The assembly as described in claim 10, said servo cam cycling range further comprising being between a 0.000" home position and a 0.400" lift position.

12. The assembly as described in claim 9, further comprising pivot linkages respectively associated with first and second brackets, between which said programmable counterbalance component is supported and which, upon being actuated, exerts a lifting force to said mounting rail which is in turn likewise connected to said pair of continuous force hold down components.

13. The assembly as described in claim 12, further comprising an extending length of said counterbalance component extending at an intermediate angle between a horizontal axis and a vertical axis.

14. The assembly as described in claim 7, further comprising an overhead and crosswise extending support beam extending above said feed rollers, a pair of horizontal brackets supported by said overhead beam and extending forwardly such that said spaced apart pair of continuous force applying components are anchored thereto in downwardly extending fashion, lower ends of said continuous force applying components being pivotally engaged to a mounting rail associated with said displaceable upper feed roller.

15. A feed assembly for transferring an uncoiled sheet material to a downstream material forming operation, said assembly comprising:

a frame including a pair of side support plates, between which a cam shaft with end support cam lobe is provided in supported and extending fashion;

a servo cam and gearbox for operating said cam shaft for providing responsive movement of said upper feed roller relative to said lower feed roller;

upper and lower feed rollers rotary supported between said side support plates and between which said sheet material passes, at least one of said rollers being rotary driven, said upper roller including a supporting structure with an end support roller in contact with said cam lobe, such that said displaceable roller is actuated between engaging or disengaging positions relative to an upper surface of the sheet material;

at least one continuous force applying component exerting a hold down force against said upper feed roller; and a programmable counterbalance component calibrated to counter the hold down force exerted by said force applying components and in order to cycle the upper roller between the engaged and disengaged positions during advance cycling of the uncoiled material to the downstream material forming operation.

* * * * *